US005478706A

United States Patent [19]

Marchesano et al.

[11] Patent Number: 5,478,706

[45] Date of Patent: Dec. 26, 1995

[54] ALKALINE BLACK-AND-WHITE DEVELOPER FOR SILVER HALIDE PHOTOGRAPHIC MATERIAL

[75] Inventors: Carlo Marchesano; Filippo Faranda, both of Savona; Franco Buriano, Carcare, all of Italy

[73] Assignee: Minnesota Mining And Manufacturing Company, St. Paul, Minn.

[21] Appl. No.: 206,196

[22] Filed: Mar. 3, 1994

Related U.S. Application Data

[63] Continuation of Ser. No. 858,313, Mar. 25, 1992, abandoned.

[30] Foreign Application Priority Data

Apr. 3, 1991 [IT] Italy ..... MI91A0925

[51] Int. Cl.[6] ..... G03C 5/46

[52] U.S. Cl. ..... 430/486; 430/436; 430/478

[58] Field of Search ..... 430/419, 420, 430/434, 435, 436, 438, 441, 456, 464, 478, 484, 486, 487, 489, 490, 491, 492

[56] References Cited

U.S. PATENT DOCUMENTS

| | | | |
|---|---|---|---|
| 2,371,740 | 3/1945 | Dearing et al. | 95/88 |
| 2,409,107 | 10/1946 | Crabtree et al. | 95/88 |
| 2,482,546 | 9/1949 | Kaszuba | 95/88 |
| 2,702,244 | 2/1955 | Land | 95/88 |
| 3,865,591 | 2/1975 | Katz | 430/491 |
| 4,269,929 | 5/1981 | Nothnagle | 430/481 |
| 4,756,997 | 7/1988 | Marchesano | 430/464 |
| 4,987,060 | 1/1991 | Marchesano | 430/464 |
| 5,167,875 | 12/1992 | De Rycke et al. | 430/603 |

FOREIGN PATENT DOCUMENTS

| | | | |
|---|---|---|---|
| 0032456 | 7/1981 | European Pat. Off. | G03C 5/26 |
| 0286874 | 10/1988 | European Pat. Off. | G03C 5/30 |
| 524592 | 8/1940 | United Kingdom . | |
| 561203 | 5/1944 | United Kingdom . | |
| 1212051 | 11/1970 | United Kingdom | G03C 5/26 |

OTHER PUBLICATIONS

*World Patents Index Latest,* Section PQ, Week 8916, Derwent Publications Ltd., London, GB; Class P83, AN 89–11863 and JP–A–1 063 959 (Konishiroku Photo–Industry Co. Ltd.) 9 Mar. 1989 "abstract".

*Primary Examiner*—Hoa Van Le

*Attorney, Agent, or Firm*—Gary L. Griswold; Walter N. Kirn; Susan Moeller Zerull

[57] ABSTRACT

The present invention relates to an alkaline aqueous black-and-white photographic developer composition comprising:

(1) at least one black-and-white developing agent, (2) at least one black-and-white auxiliary developing agent, (3) at least one antifoggant, (4) at least one sequestering agent, (5) a sulfite antioxidant, (6) at least one buffering agent, (7) a tone agent, and (8) at least one tone promoting agent, wherein said tone agent is a primary organic amine compound and said tone promoting agent is a silver halide solvent.

21 Claims, No Drawings

ALKALINE BLACK-AND-WHITE DEVELOPER FOR SILVER HALIDE PHOTOGRAPHIC MATERIAL

This is a continuation of application Ser. No. 07/858,313 filed Mar. 25, 1992, now abandoned.

FIELD OF THE INVENTION

The present invention relates to an alkaline black-and-white developer for processing a silver halide photographic material and, more particularly, to an alkaline black-and-white developer for processing a silver halide radiographic material in an automatic processor. The developer provides improved color tone, stability to air oxidation and excellent photographic properties.

BACKGROUND OF THE ART

The color tone of developed silver is a matter of great concern for photographic film makers. The color tone of black and white developed images not only depends on the photographic materials used but also on the grain size, grain thickness, grain structure, grain surface and reflecting power of the developed silver.

It is well known that the warmest tones (yellowish, brownish) can give an unfavorable impression to the observer of the resulting picture image. For this reason a trade requirement of photographic films, in particular for medical X-ray films, is a cold tone (blue-black) in order to make diagnoses easier.

The idea of changing the color tone of a black-and-white image is almost as old as the process of making a black-and-white print itself.

It is known in the art that compounds called toners may be added to emulsion preparations to produce a colder or blacker image after development. References can be found in U.S. Pat. Nos. 4,818,675, 4,201,582, 3,695,880, and 2,512,721, in EP Appl. 271,309, in JP Patent Laid-Open 61/170,739.

It is also known that other chemical ingredients for blue-black image formation can be used with a separate toning bath and or activator bath. Reference can be found in U.S. Pat. Nos. 4,201,582, 3,622,332, 2,192,891 and 2,156,626, Research Disclosure Item 29963, March 1989; Photographic Science & Engineering, Vol 7, No. 2 "Observation on fine structure of developed silver in the presence of added tone modifiers"; C.E.K. Mees, *The Theory of the Photographic Process,* 1st Edition, p. 568, The Macmillan Co., New York; and A. Rott & E. Weide, Photographic silver halide diffusion processes, pp 61–65, 1972.

The silver image commonly formed during normal development is black, although some silver grains may appear to have warm tone by reflected light. This difference is principally due to a difference in size and in structure of the developed metallic silver particles.

The two pathways to the reduction of silver ions are physical and chemical development. In physical development, which involves a homogeneous chemical reaction, the developing agent reduces a soluble silver salt that is added (or has been make soluble from the silver halide emulsion layer) to the developer, and the formed metallic silver is deposited on the latent image nuclei, resulting in a developed image consisting of compact, rounded particles. In chemical or direct development, which involves a heterogeneous chemical reaction, the silver halide of the grain that has been image-wise exposed is reduced in situ, resulting in a developed image consisting of particles of filamentary structure.

The tight packing of chemically developed filamentary silver ensures the spectral neutrality of this type of silver image and the black color thus appears to be due to multiple scattering and absorption of light. James and Vanselow, in Photographic Science & Engineering, Vol. 1 No. 3, January 1958, "The Influence of the Development Mechanism on the Color and Morphology of Developed Silver" showed that the greater the extent of physical development, the less black was the silver image, the color usually passing to a brownish hue.

The presence of silver halide solvents can dissolve some of the silver halide of the emulsion with the result that the image is formed partly by physical development and is affected by warm tones. In order to reduce as low as possible this physical development it is known to use these compounds in the lowest quantities.

Now, we have surprisingly found that the use of silver halide solvents in combination with organic primary amines dramatically improves the blue-black tone of developed silver and the speed of the black-and-white photographic film.

SUMMARY OF THE INVENTION

The present invention relates to an alkaline aqueous black-and-white photographic developer comprising, (1) at least one black-and-white developing agent, (2) at least one black-and-white auxiliary developing agent, (3) at least one antifoggant, (4) at least one sequestering agent, (5) a sulfite antioxidant, (6) at least one buffering agent, (7) a tone agent, and (8) at least one tone promoting agent wherein said tone agent is a primary organic amine compound and said tone promoting agent is a silver halide solvent.

This developer provides an improvement of both the sensitometric characteristics and the silver blackness of the photographic image obtained from a silver halide photographic material. Moreover, it provides a reduction of dark sludge which often forms on the rollers of an automatic developing processor.

In another aspect, the present invention relates to a developer composition comprising, (1) at least one black-and-white developing agent, (2) at least one black-and-white auxiliary developing agent, (3) at least one antifoggant, (4) at least one sequestering agent, (5) a sulfite antioxidant, (6) at least one buffering agent, and (7) a tone modifying agent, wherein said tone modifying agent is an alkali metal or ammonium tetrathionate.

DETAILED DESCRIPTION OF THE INVENTION

Accordingly, the present invention relates to an alkaline aqueous black-and-white photographic developer comprising, (1) at least one black-and-white developing agent, (2) at least one black-and-white auxiliary developing agent, (3) at least one antifoggant, (4) at least one sequestering agent, (5) a sulfite antioxidant, (6) at least one buffering agent, (7) a tone agent, and (8) at least one tone promoting agent, wherein said tone agent is a primary organic amine compound and said tone promoting agent is a silver halide solvent.

The components of the alkaline aqueous black-and-white photographic developer to be used in the present invention will hereinafter be explained in detail.

Primary organic amines useful in the photographic developer of the present invention are compounds well known in the art. In a preferred embodiment said primary amines correspond to the following formula:

$$R—NH_2$$

wherein R can be a substituted or unsubstituted, straight or branched or cyclic aliphatic chain of from 1 to 10 carbon atoms.

Straight aliphatic primary amines can be, for example, methylamine, ethylamine, 1-propylamine, 2-propylamine, 1-butylamine, 1-pentylamine, 2-pentylamine, 3-heptylamine, and the like.

Branched primary amines can be, for example, 1-isobutylamine, 2-methyl-1-butylamine, 3-ethyl-1- pentylamine, 3-ethyl-2-hexylamine, 2,3-dimethyl-1-butylamine, and the like.

Cyclic primary amines can be, for example, cyclopentylamine, cyclohexylamine, cycloheptylamine, 2-methyl1-cyclopentylamine, and the like.

The aliphatic chain of said aliphatic primary amines can be optionally modified with substituents well known in the organic chemistry, such as, for example, halogen atoms, nitro group, carboxy group, alkyloxy group, aryloxy group, aralkyloxy group, acyloxy group, carbamoyl group, hydroxy group, thio group, alkylthio group, sulfo group, and the like.

The amount of said primary organic amine added in the developer composition of the present invention is comprised in the range of from $1\times10^{-3}$ to 2 Moles per liter, more preferably of from $1\times10^{-2}$ to 1 Moles per liter of ready-to-use developer.

Silver halides solvents useful in the photographic developer of the present invention are solutions or compounds well known in the art. They comprise soluble halide salts, (e.g., NaBr, KCl), thiosulfates (e.g. sodium thiosulfate, potassium thiosulfate and ammonium thiosulfate), sulfites (e.g., sodium sulfite), ammonium salts (e.g. ammonium chloride), thiocyanates (e.g., potassium thiocyanate, sodium thiocyanate, ammonium thiocyanate), thiourea, imidazole compounds (e.g., 2-methylimidazole as described in U.S. Pat. No. 3,708,299) and thioether compounds.

In a preferred embodiment the photographic developer of the present invention comprises thiosulfates and thiocyanates, alone or in combination with each other. In a more preferred embodiment the photographic developer of the present invention comprises alkali metal or ammonium thiosulfates or thiocyanates, alone or in combination with each other. The amount of the silver halide solvent used varies depending on the type of the silver halide solvent. The total amount of the silver halide solvents is generally comprised in the range of from 0.01 to 50 mMoles per liter, more preferably in the range of from 0.1 to 30 mMoles per liter of ready-to-use developer composition.

Althought these compounds were already known in the art, there is no known disclosure of the specific combination of silver halide solvents with primary organic amines for improving both the black-blue tone of developed silver and the speed of a silver halide photographic material.

According to a preferred embodiment, a tone modifying agent may be added to the developer composition of the present invention. The tone modifying agent can comprise ammonium or alkali metal salts of polythionic acids (i.e. trithionic acid $H_2S_3O_6$, tetrathionic acid $H_2S_4O_6$, pentathionic acid $H_2S_5O_6$, hexathionic acid $H_2S_6O_6$ and the like). In a preferred embodiment, the tone modifying agent of the present invention comprises tetrathionates of alkali metals or ammonium. The tone modifying agent may be added in an amount in the range of from 0.01 to 0.4 grams per liter, and more preferably from 0.05 to 0.3 grams per liter of ready-to-use developer composition.

In another aspect, the present invention relates to a developer composition comprising, (1) at least one black-and-white developing agent, (2) at least one black-and-white auxiliary developing agent, (3) at least one antifoggant, (4) at least one sequestering agent, (5) a sulfite antioxidant, (6) at least one buffering agent, and (7) a tone modifying agent, wherein said tone modifying agent is an alkali metals or ammonium tetrathionate.

Said tone modifying agent may be added to said developer composition in an amount in the range of from 0.4 to 5 grams per liter, and more preferably of from 0.5 to 2.5 grams per liter.

The developing agents for silver halide photographic elements suitable for the purposes of the present invention include hydroquinone and substituted hydroquinones (e.g. t-butylhydroquinone, methylhydroquinone, dimethylhydroquinone, chlorohydroquinone, dichlorohydroquinone, bromohydro- quinone, 1,4-dihydroxynaphthalene, methoxyhydroquinone, ethoxyhydroquinone, etc.). Hydroquinone, however, is preferred. Said silver halide developing agents are generally used in an amount from about 2 to 100 grams per liter, preferably 6 to 50 grams per liter of the ready-to-use developer composition.

Such developing agents can be used alone or in combination with auxiliary developing agents which show a superadditive affect, such as p-aminophenol and substituted p-aminophenol (e.g. N-methyl-p-aminophenol or metol and 2,4-diaminophenol) and pyrazolidones (e.g. 1-phenyl-3-pyrazolidone or phenidone) and substituted pyrazolidones (e.g., 4-methyl-1-phenyl-3-pyrazolidone, 4-hydroxymethyl-4-methyl-l-phenyl-3-pirazolidone, and 4,4'-dimethyl-1-phenyl-3-pyrazolidone or dimezone). These auxiliary developing agents are generally used in an amount from about 0.1 to 20, preferably 0.5 to 5 grams per liter of ready-to-use developer composition.

The antifogging agents, known in the art to eliminate fog on the developed photographic silver halide films, useful in the developer composition of this invention include derivatives of benzimidazole, benzotriazole, tetrazole, indazole, thiazole, etc. Preferably, according to the present invention, the developer comprises a combination of benzotriazole-, indazole- and mercaptoazole-type antifoggants, more preferably a combination of 5-methylbenzotriazole, 5-nitroindazole and 1-phenyl-5-mercaptotetrazole. Other examples of mercaptoazoles are described in U.S. Pat. No. 3,576,633, and other examples of indazole type antifoggants are described in U.S. Pat. No. 2,271,229. More preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5-thiol and 5-methylbenzotriazole and 1-phenyl-1-H-tetrazole-5-thiol. The most preferred combination is 5-methylbenzotriazole and 1-phenyl-1-H-tetra- zole-5-thiol. These mixtures are used in a total amount of from about 0.01 to 5, preferably 0.02 to 3 grams per liter of the ready-to-use developer composition. Of course optimum quantities of each compound and proportion can be found by the skilled in the art to respond to specific technical needs. In particular, 5-methylbenzotriazoles have been found to give the best results when used in mixture with 1-phenyl-1-H-tetrazole-5-thiol, the latter being present in minor amount with respect to the weight of the total mixture, in a percent of less than 20%, preferably less than 10%.

The developer, comprising said antifoggant combination, is advantageously used in a continous transport processing machine at high temperature processing (higher than 30° C.) for processing of X-ray materials without changes in the sensitometric properties of the material, mainly without a substantial increase of the fog of the developed material.

The sequestering agents used in the present invention are sequestering agents known in the art such as, for example, aminopolycarboxylic acids (ethylenediaminotetraacetic acid, diethylenetriaminepentaacetic acid, nitrilotriacetic acid, diaminopropanoltetraacetic acid, etc.), aminopolyphosphonic acids (methylaminophosphonic acid, phosphonic acids described in Research Disclosure 18837 of Dec. 1979, phosphonic acids described in U.S. Pat. No. 4,596,764, etc.), cyclicaminomethane diphosphonic acids (as described in EP Appl. No. 286,874), polyphosphate compounds (sodium hexametaphosphate, etc.), a-hydroxycarboxylic acid compounds (lactic acid, tartaric acid, etc.), dicarboxylic acid compounds (malonic acid, etc.), a-ketocarboxylic acid compounds (pyruvic acid, etc.), alkanolamine compounds (diethanolamine, etc.), etc.

In a particular embodiment, said cyclicaminomethane diphosphonic acid compounds correspond to the following formula

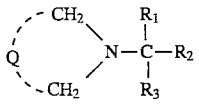

(I)

wherein $R_1$, $R_2$and $R_3$,equal or different, each represents a hydrogen atom or a $PO_3M'M''$ group, wherein M' and M" represent a hydrogen atom, an alkali metal such as Li, Na or K or a quaternary ammonium group such as ammonium, pyridinium, triethanolammonium or triethylammonium, and Q represents the atoms or chemical bonds necessary to complete a 3- to 6-membered ring such as aziridino, pyrrolidino, imidazolidino, piperidino, isoindolino or morpholino, with the proviso that at least two of $R_1$,$R_2$ and $R_3$ substituents represent a $PO_3M'M''$ group.

Typical examples of sequestering agents within the general formula above are:

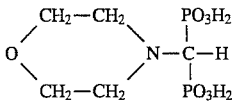

(1)

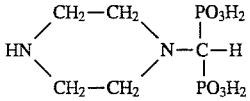

(2)

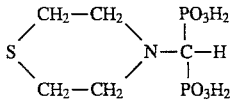

(3)

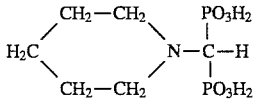

(4)

-continued

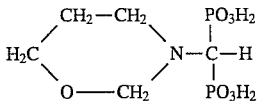

(5)

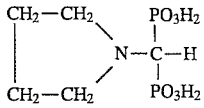

(6)

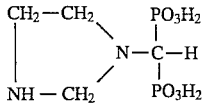

(7)

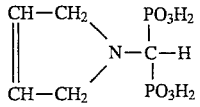

(8)

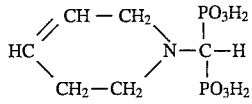

(9)

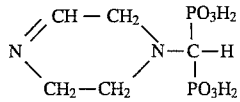

(10)

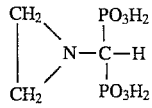

(11)

The above sequestering agents can be used alone or in combination each other. More preferably, particular mixtures of these sequestering agents are useful to assure strong resistence to air oxidation; such preferred mixtures include mixtures of aminopolycarboxylic acids and cyclicaminomethane diphosphonic acids (according to formula (I) above). Said sequestering agents can be advantageously used in a total amounts of from about 1 to about 60 grams per liter, preferably of from about 2 to about 30 grams per liter of ready-to-use developer. Of course optimum quantities of each compound and proportion can be found by the skilled in the art to respond to specific technical needs. The sequestering agents incorporated into the black-and-white developer of the present invention have been found to increase the stability of the developer over a long period of time.

The term "sulfite antioxidants", is meant those compounds known in the art as capable of generating sulfite ions ($SO_3$— in aqueous solutions and include sulfites, bisulfites, metabisulfites (1 mole of metabisulfite forming 2 moles of bisulfite in aqueous solution) and aldehyde bisulfite adducts. Examples of sulfites, bisulfites, and metabisulfites include sodium sulfite, sodium bisulfite, sodium metabisulfite, potassium sulfite, potassium bisulfite, potassium metabisulfite and ammonium metabisulfite. The amount of the total sulfite ions is preferably not less than 0.05 moles, more preferably 0.1 to 1.25 moles, and most preferably 0.3 to 0.9 moles, per liter of developer. The amount of the sulfite ions with respect to the hydroquinone preferably exceeds a molar ratio of 2.5:1 and, more preferably, is between 2.5:1 to 4:1.

The developer in accordance with the present invention further includes a buffer (e.g., carbonic acid salts, phosphoric acid salts, polyphosphates, metaborates, boric acid and boric acid salts). The amount of the buffer with respect to the sulfite preferably exceeds a molar ratio of 0.5:1 and, more preferably, is between 1:1 to 2:1.

In the developer composition there are used inorganic alkaline agents to obtain the preferred pH which is usually higher than 10. Said inorganic alkaline agents include KOH, NaOH, LiOH, sodium and potassium carbonate, etc.

Other adjuvants well known to the skilled in the art of developer formulation may be added to the developer of the present invention. These include restrainers, such as the soluble halides (e.g., KBr), solvents (e.g., polyethylene glycols and esters thereof), development accelerators (e.g., polyethylene glycols and pyrimidinium compounds), preservatives, surface active agents, and the like.

The developer of the invention is prepared by dissolving the ingredients in water and adjusting the pH to the desired value. The pH value of the developer of the present invention is comprised in the range of from 9 to 12, more preferably of from 10 to 11. The developer may also be prepared in a concentrated form and then diluted to a working strength just prior to use. The developer may be prepared in two or more concentrated parts to be combined and diluted with water to the desired strength and placed in the developing tank of the automatic processing machine.

The developer of the present invention is particularly useful when processing is carried out in an automatic processing machines. Automatic processing machines may be of the type described in U.S. Pat. No. 3,545,971, such as an "X-OMAT Processor" made by Eastman Kodak Company, of the series of "TRIMATIC" Processors made by 3M Company and of the type of "Model RK" made by Fuji Photo Film Company. The developing temperature and the developing time are in relation to each other and are dependant on the total processing time. In general, they are about 20° C. to 50° C., and 10 seconds to 120 seconds, respectively.

After development in the developer of the present invention, the silver halide material is fixed, preferably in an acid fixer, and washed and dried in the usual manner. In the automatic processing machine, these steps are determined by the machine.

The silver halide photographic materials which can be used in the present invention comprise a support and at least one silver halide emulsion layer coated on the support. The silver halide emulsion layer may be coated on one side of the support or on both sides thereof. The silver halide photographic element can comprise other non light-sensitive layers, such as backing layers, antihalation layers, interlayers, filter layers, protective layers. The silver halide emulsion comprises silver halide grains (such as silver chloride, silver bromide, silver chlorobromide, silver bromoiodide, silver chlorobromoiodide) dispersed in an hydrophilic colloid (such as gelatin, modified gelatins, albumin, casein, sodium alginate, carboxymethyl cellulose, polyvinyl alcohol, polyvinyl pyrrolidone and mixtures thereof). The emulsion can contain cubic, octahedral, spherical and/or tabular silver halide grains. The emulsion can be chemical and optical sensitized and added during its manufacture or before its coating various additives, such as stabilizers, antifoggants, hardeners, coating aids, etc. The silver halide emulsion is coated on a support such as a cellulose acetate film, or a polyester (e.g., polyethylene terephthalate) film using coating, priming, and subbing methods well known in the art, and dried.

The following examples illustrate the aqueous alkaline black-and-white developer of this invention more specifically, being understood, however, that the invention is not limited to these examples.

EXAMPLE 1

Aqueous alkaline developers 1 to 7, having the composition shown in Table 1, for silver halide black-and-white photographic materials were prepared.

TABLE 1

| | | Developer | | | | | | |
|---|---|---|---|---|---|---|---|---|
| | | 1 | 2 | 3 | 4 | 5 | 6 | 7 |
| Water | g | 700 | 700 | 700 | 700 | 700 | 700 | 700 |
| $Na_2S_2O_5$ | g | 30 | 30 | 30 | 30 | 30 | 30 | 30 |
| KOH 35% (w/w) | g | 54 | 64 | 71 | 43 | 43 | 35 | 48 |
| $K_2CO_3$ | g | 41 | 41 | 41 | 41 | 41 | 41 | 41 |
| Diethanolamine | g | 6 | 6 | 6 | 6 | 6 | 6 | 6 |
| Ethyleneglycol | g | 7.5 | 7.5 | 7.5 | 7.5 | 7.5 | 7.5 | 7.5 |
| DTPA.5Na 40% (w/W) | g | 12.5 | 12.5 | 12.5 | 12.5 | 12.5 | 12.5 | 12.5 |
| Ethanolamine | g | — | — | — | 10 | 10 | — | — |
| Ethylamine | g | — | — | — | — | — | 10.5 | — |
| Ethylenediamine | g | — | — | — | — | — | — | 5 |
| 5-Methylbenzotriazole | mg | — | — | — | — | 125 | — | — |
| 1-Phenyl-1-H-tetrazole-5-thiol | mg | — | — | — | — | 15 | — | — |
| 4-Hydroxymethyl-4-methyl-1-phenyl-3-pyrazolidone | g | 1.3 | 1.3 | 1.3 | 1.3 | 1.3 | 1.3 | 1.3 |
| Hydroquinone | g | 12 | 12 | 12 | 12 | 12 | 12 | 12 |
| Potassium bromide | g | 1.5 | 1.5 | 1.5 | 1.5 | 1.5 | 1.5 | 1.5 |
| Water to make | l | 1 | 1 | 1 | 1 | 1 | 1 | 1 |
| pH at 20° C. | | 10.5 | 11.0 | 11.5 | 10.7 | 10.7 | 10.7 | 10.7 |

An infrared sensitized photographic emulsion containing silver bromide fine grains was coated on one side of two photographic supports to have two photographic films at different Ag coverage:

A: 1.47 g/m$^2$

B: 1.78 g/m$^2$ exposed at 780 nm by a laser sensitometer, and then processed using developers 1 to 7, for 12 seconds at 35° C., followed by acid stopping for 8 seconds at 35° C., fixing in 3M XAF/3 Fixer (comprising essentially an acid water solution of ammonium tiosulfate and a hardener) for 8 seconds at 35° C., washing in tap water for 20 seconds at 35° C. and drying for 22 seconds at 35° C. The results are summarized in the following Table 2. The image tone of the developed silver was determined on a trasmission densitometer at a visual film density of 1.20. The reported yellow densities are the differences between the visual densities and the color densities (determined through a blue filter) multiplied by 1000. Therefore a −110 yellow value would correspond to a yellow density of 0.11 less than the 1.20 visual density (because the density obtained by the blue filter is 1.09). The lower the yellow value, the better the blue-black tone. Reference to this method of evaluation can be found in U.S. Pat. No. 4,201,582 and in "The Influence of Development Mechanism on the Color and Morphology of Developed Silver" by T. H. James and W. Vanselow (Phot. Science & Eng. Vol. 1, No. 3, page 107 January 1958).

TABLE 2

| Developer | Film | D.min | D.max | Speed | Average Contrast | Image Tone |
|---|---|---|---|---|---|---|
| 1 | A | 0.18 | 3.62 | 1.71 | 3.40 | +50 |
| 2 | A | 0.18 | 3.54 | 1.69 | 3.40 | +40 |
| 3 | A | 0.18 | 3.54 | 1.72 | 3.38 | +50 |
| 4 | A | 0.20 | 3.77 | 1.99 | 3.14 | −120 |
| 5 | A | 0.17 | 3.55 | 1.74 | 3.16 | −40 |
| 6 | A | 0.19 | 3.71 | 1.93 | 3.10 | −120 |
| 7 | A | 0.30 | 3.82 | 2.12 | 3.55 | −180 |
| 1 | B | 0.18 | 3.96 | 1.81 | 3.16 | −20 |
| 2 | B | 0.18 | 3.95 | 1.82 | 3.06 | −20 |
| 3 | B | 0.18 | 4.00 | 1.85 | 3.17 | −40 |
| 4 | B | 0.19 | 4.17 | 1.94 | 3.36 | −130 |
| 5 | B | 0.17 | 4.01 | 1.85 | 2.99 | −90 |
| 6 | B | 0.20 | 4.21 | 2.02 | 3.17 | −150 |
| 7 | B | 0.25 | 4.11 | 2.14 | 3.23 | −190 |

These results clearly show as the presence of alkyl amines increases the blue-black tone of developed silver and the speed of photographic film. Alkylamines negatively affect the D.min value. The presence of 5-methyl-benzotriazole antifogging agent dramatically increases the yellow tone.

EXAMPLE 2

Aqueous alkaline developers 8 to 14, having the composition shown in Table 3, for silver halide black-and-white photographic materials were prepared.

TABLE 3

| | | Developer | | | | | | |
|---|---|---|---|---|---|---|---|---|
| | | 8 | 9 | 10 | 11 | 12 | 13 | 14 |
| Water | g | 700 | 700 | 700 | 700 | 700 | 700 | 700 |
| $Na_2S_2O_5$ | g | 30 | 30 | 30 | 30 | 30 | 30 | 30 |
| KOH 35% (w/w) | g | 35 | 45 | 56 | 56 | 57 | 45 | 58 |
| $K_2CO_3$ | g | 41 | 41 | 41 | 41 | 41 | 41 | 41 |
| Diethanolamine | g | 6 | 6 | 6 | 6 | 6 | 6 | 6 |
| Ethyleneglycol | g | 7.5 | 7.5 | 7.5 | 7.5 | 7.5 | 7.5 | 7.5 |
| DTPA.5Na 40% (w/W) | g | 12.5 | 12.5 | 12.5 | 12.5 | 12.5 | 12.5 | 12.5 |
| 3-Diethylamine-1,2-propanediol | g | 25 | — | — | — | — | — | — |
| Morpholine | g | — | 15 | — | — | — | — | — |
| 2-Amino-Pyrimidine | g | — | — | 10 | — | — | — | — |
| Pyridine | g | — | — | — | 10 | — | — | — |
| Benzoylhydrazine | g | — | — | — | — | 1 | — | — |
| Piperazine | g | — | — | — | — | — | 10 | — |
| Salicylhydrazide | g | — | — | — | — | — | — | 1 |
| 4-Hydroxymethyl-4-methyl-1-phenyl-3-pyrazolidone | g | 1.3 | 1.3 | 1.3 | 1.3 | 1.3 | 1.3 | 1.3 |
| Hydroquinone | g | 12 | 12 | 12 | 12 | 12 | 12 | 12 |
| Potassium bromide | g | 1.5 | 1.5 | 1.5 | 1.5 | 1.5 | 1.5 | 1.5 |
| Water to make | l | 1 | 1 | 1 | 1 | 1 | 1 | 1 |
| pH at 20° C. | | 10.7 | 10.7 | 10.7 | 10.7 | 10.7 | 10.7 | 10.7 |

The developer compositions 8 to 14 were tested according the same method of example 1. The results are summarized in Table 4.

TABLE 4

| Developer | Film | D.min | D.max | Speed | Average Contrast | Image Tone |
|---|---|---|---|---|---|---|
| 8 | A | 0.17 | 3.68 | 1.78 | 3.73 | 0 |
| 9 | A | 0.18 | 3.75 | 1.86 | 3.78 | −60 |
| 10 | A | 0.18 | 3.71 | 1.83 | 3.67 | −20 |
| 11 | A | 0.20 | 3.76 | 1.98 | 3.17 | −20 |
| 12 | A | 0.18 | 3.67 | 1.74 | 3.55 | +70 |
| 13 | A | 0.18 | 3.76 | 1.87 | 3.55 | 0 |
| 14 | A | 0.18 | 3.69 | 1.75 | 3.53 | +60 |
| 8 | B | 0.18 | 4.05 | 1.88 | 3.40 | −60 |
| 9 | B | 0.18 | 4.37 | 1.97 | 3.25 | −110 |
| 10 | B | 0.18 | 4.03 | 1.94 | 3.24 | −40 |
| 11 | B | 0.20 | 4.00 | 2.04 | 3.22 | −60 |
| 12 | B | 0.18 | 4.13 | 1.86 | 3.30 | −10 |
| 13 | B | 0.18 | 4.19 | 1.93 | 3.20 | −40 |
| 14 | B | 0.18 | 3.96 | 1.80 | 3.31 | −40 |

As clearly shown from these examples, the presence of the —$NH_2$ group in the tone agent is peculiar for the effect on the yellow value. None of these compounds imparts a good image tone.

EXAMPLE 3

Aqueous alkaline developers 15 to 21, having the composition shown in Table 5, for silver halide black-and-white photographic materials were prepared.

TABLE 5

| | | Developer | | | | | | |
|---|---|---|---|---|---|---|---|---|
| | | 15 | 16 | 17 | 18 | 19 | 20 | 21 |
| Water | g | 700 | 700 | 700 | 700 | 700 | 700 | 700 |
| $Na_2S_2O_5$ | g | 30 | 30 | 30 | 30 | 30 | 30 | 30 |
| KOH 35% (w/w) | g | 55 | 38 | 38 | 38 | 43 | 43 | 43 |
| $K_2CO_3$ | g | 41 | 41 | 41 | 41 | 41 | 41 | 41 |
| Diethanolamine | g | 6 | 6 | 6 | 6 | 6 | 6 | 6 |
| Ethyleneglycol | g | 7.5 | 7.5 | 7.5 | 7.5 | 7.5 | 7.5 | 7.5 |
| DTPA.5Na 40% (w/W) | g | 12.5 | 12.5 | 12.5 | 12.5 | 12.5 | 12.5 | 12.5 |
| Ethanolamine | g | — | — | — | — | 10 | 10 | 10 |
| Ethylamine | g | — | 10.5 | 10.5 | 10.5 | — | — | — |
| Ethylenediamine | g | — | — | — | — | — | — | — |
| NaCNS | mg | — | — | 100 | 100 | — | 100 | 100 |
| $Na_2S_2O_3$ | mg | — | 190 | — | 190 | 190 | — | 190 |
| 4-Hydroxymethyl-4-methyl-1-phenyl-3-pyrazolidone | g | 1.3 | 1.3 | 1.3 | 1.3 | 1.3 | 1.3 | 1.3 |
| Hydroquinone | g | 12 | 12 | 12 | 12 | 12 | 12 | 12 |
| Potassium bromide | g | 1.5 | 1.5 | 1.5 | 1.5 | 1.5 | 1.5 | 1.5 |
| Water to make | l | 1 | 1 | 1 | 1 | 1 | 1 | 1 |
| pH at 20° C | | 10.7 | 10.7 | 10.7 | 10.7 | 10.7 | 10.7 | 10.7 |

The developer compositions 15 to 21 were tested according the same method of example 1. The results are summarized in Table 6.

TABLE 6

| Developer | Film | D.min | D.max | Speed | Average Contrast | Image Tone |
|---|---|---|---|---|---|---|
| 15 | A | 0.18 | 3.68 | 1.77 | 3.46 | +40 |
| 16 | A | 0.23 | 3.58 | 2.02 | 3.67 | −180 |
| 17 | A | 0.20 | 3.66 | 1.94 | 3.11 | −120 |
| 18 | A | 0.23 | 3.60 | 2.00 | 3.38 | −170 |
| 19 | A | 0.26 | 3.53 | 2.04 | 3.49 | −190 |
| 20 | A | 0.21 | 3.84 | 1.97 | 3.29 | −150 |
| 21 | A | 0.25 | 3.57 | 2.05 | 3.51 | −180 |
| 15 | B | 0.18 | 3.99 | 1.82 | 3.14 | −40 |
| 16 | B | 0.24 | 4.12 | 2.05 | 3.53 | −190 |
| 17 | B | 0.20 | 4.04 | 2.00 | 3.13 | −145 |
| 18 | B | 0.21 | 3.88 | 2.07 | 3.42 | −190 |
| 19 | B | 0.27 | 3.94 | 2.07 | 3.67 | −190 |

TABLE 6-continued

| Developer | Film | D.min | D.max | Speed | Average Contrast | Image Tone |
|---|---|---|---|---|---|---|
| 20 | B | 0.22 | 4.00 | 2.08 | 3.47 | −170 |
| 21 | B | 0.24 | 3.91 | 2.05 | 3.52 | −190 |

These results clearly show that the presence of a silver halide solvent such as sodium thiosulfate or sodium thiocyanate in a developing solution which contains a primary organic amine greatly improves the blue-black tone of developed silver.

EXAMPLE 4

Aqueous alkaline developers 22 to 28, having the composition shown in Table 7, for silver halide black-and-white photographic materials were prepared.

TABLE 7

| | | Developer | | | | | | |
|---|---|---|---|---|---|---|---|---|
| | | 22 | 23 | 24 | 25 | 26 | 27 | 28 |
| Water | g | 700 | 700 | 700 | 700 | 700 | 700 | 700 |
| $Na_2S_2O_5$ | g | 30 | 30 | 30 | 30 | 30 | 30 | 30 |
| KOH 35% (w/w) | g | 43 | 38 | 38 | 38 | 43 | 43 | 43 |
| $K_2CO_3$ | g | 41 | 41 | 41 | 41 | 41 | 41 | 41 |
| Diethanolamine | g | 6 | 6 | 6 | 6 | 6 | 6 | 6 |
| Ethyleneglycol | g | 7.5 | 7.5 | 7.5 | 7.5 | 7.5 | 7.5 | 7.5 |
| DTPA.5Na 40% (w/W) | g | 12.5 | 12.5 | 12.5 | 12.5 | 12.5 | 12.5 | 12.5 |
| Ethanolamine | g | 10 | 10 | 10 | — | — | — | — |
| Ethylamine | g | — | — | — | 10.5 | 10.5 | 10.5 | — |
| Ethylenediamine | g | — | — | — | — | — | — | — |
| $K_2S_4O_6$ | mg | 150 | — | 150 | 150 | — | 150 | — |
| $Na_2S_2O_3$ | mg | — | 190 | 190 | — | 190 | 190 | — |
| 5-Methylbenzotriazole | mg | 125 | 125 | 125 | 125 | 125 | 125 | 125 |
| 1-Phenyl-1-H-tetrazole-5-thiol | mg | 15 | 15 | 15 | 15 | 15 | 15 | 15 |
| 4-Hydroxymethyl-4-methyl-1-phenyl-3-pyrazolidone | g | 1.3 | 1.3 | 1.3 | 1.3 | 1.3 | 1.3 | 1.3 |
| Hydroquinone | g | 12 | 12 | 12 | 12 | 12 | 12 | 12 |
| Potassium bromide | g | 1.5 | 1.5 | 1.5 | 1.5 | 1.5 | 1.5 | 1.5 |
| Water to make | l | 1 | 1 | 1 | 1 | 1 | 1 | 1 |
| pH at 20° C. | | 10.7 | 10.7 | 10.7 | 10.7 | 10.7 | 10.7 | 10.7 |

The developer compositions 22 to 28 were tested according the same method of example 1. The results are summarized in Table 8.

TABLE 8

| Developer | Film | D.min | D.max | Speed | Average Contrast | Image Tone |
|---|---|---|---|---|---|---|
| 22 | A | 0.18 | 3.42 | 1.78 | 3.06 | 0 |
| 23 | A | 0.19 | 3.33 | 1.86 | 3.07 | −100 |
| 24 | A | 0.20 | 3.22 | 1.85 | 3.26 | −160 |
| 25 | A | 0.20 | 3.46 | 1.73 | 2.89 | −10 |
| 26 | A | 0.21 | 3.25 | 1.77 | 2.74 | −40 |
| 27 | A | 0.18 | 3.20 | 1.87 | 3.08 | −100 |
| 28 | A | 0.18 | 3.65 | 1.65 | 3.51 | +10 |
| 22 | B | 0.18 | 3.82 | 1.85 | 2.85 | −70 |
| 23 | B | 0.18 | 3.63 | 1.94 | 2.89 | −145 |
| 24 | B | 0.18 | 3.64 | 1.95 | 3.12 | −180 |
| 25 | B | 0.17 | 3.83 | 1.85 | 2.80 | −50 |
| 26 | B | 0.18 | 3.57 | 1.89 | 2.70 | −20 |
| 27 | B | 0.18 | 3.73 | 1.95 | 2.87 | −130 |
| 28 | B | 0.18 | 3.81 | 1.77 | 3.25 | −40 |

These results clearly show that the combination of the tone agent and the tone promoting agent of the present invention improves both image tone and speed of a photographic film, without affecting other photographic requirements. The best result is obtained by composition 24 which clearly shows (in comparison to compositions 22 and 23) the effect of the potassium tetrathionate (tone modifying agent) in combination with sodium thiosulfate (tone promoting agent).

EXAMPLE 5

Aqueous alkaline developers 29 to 35, having the composition shown in Table 9, for silver halide black-and-white photographic materials were prepared.

TABLE 9

| | | Developer | | | | | | |
|---|---|---|---|---|---|---|---|---|
| | | 29 | 30 | 31 | 32 | 33 | 34 | 35 |
| Water | g | 700 | 700 | 700 | 700 | 700 | 700 | 700 |
| $Na_2S_2O_5$ | g | 30 | 30 | 30 | 30 | 30 | 30 | 30 |
| KOH 35% (w/w) | g | 50 | 50 | 50 | 50 | 50 | 50 | 80 |
| $K_2CO_3$ | g | 41 | 41 | 41 | 41 | 41 | 41 | 41 |
| Diethanolamine | g | 6 | 6 | 6 | 6 | 6 | 6 | 12 |
| Ethyleneglycol | g | 7.5 | 7.5 | 7.5 | 7.5 | 7.5 | 7.5 | 7.5 |
| DTPA.5Na 40% (w/W) | g | 12.5 | 12.5 | 12.5 | 12.5 | 12.5 | 12.5 | 12.5 |
| $K_2S_4O_6$ | mg | 150 | — | — | 150 | 150 | — | 500 |
| $Na_2S_2O_3$ | mg | — | 190 | — | 190 | — | 190 | — |
| NaCNS | mg | — | — | 100 | — | 100 | 100 | — |
| 5-Methylbenzotriazole | mg | — | 125 | 125 | 125 | 125 | 125 | 80 |
| 1-Phenyl-1-H-tetrazole-5-thiol | mg | 15 | 15 | 15 | 15 | 15 | 15 | — |
| 4-Hydroxymethyl-4-methyl-1-phenyl-3-pyrazolidone | g | 1.3 | 1.3 | 1.3 | 1.3 | 1.3 | 1.3 | 1.3 |
| Hydroquinone | g | 12 | 12 | 12 | 12 | 12 | 12 | 12 |
| Potassium bromide | g | 1.5 | 1.5 | 1.5 | 1.5 | 1.5 | 1.5 | 1.5 |
| Water to make | l | 1 | 1 | 1 | 1 | 1 | 1 | 1 |
| pH at 20° C. | | 10.7 | 10.7 | 10.7 | 10.7 | 10.7 | 10.7 | 10.7 |

The developer compositions 29 to 35 were tested according the same method of example 1. The results are summarized in Table 10.

TABLE 10

| Developer | Film | D.min | D.max | Speed | Average Contrast | Image Tone |
|---|---|---|---|---|---|---|
| 29 | A | 0.17 | 3.34 | 1.69 | 3.28 | +20 |
| 30 | A | 0.17 | 3.34 | 1.73 | 3.31 | +40 |
| 31 | A | 0.17 | 3.40 | 1.70 | 3.33 | +40 |
| 32 | A | 0.18 | 3.29 | 1.70 | 3.48 | +10 |
| 33 | A | 0.17 | 3.38 | 1.66 | 3.31 | +50 |
| 34 | A | 0.18 | 3.30 | 1.70 | 3.20 | +30 |
| 35 | A | 0.20 | 2.98 | 1.99 | 3.67 | −150 |
| 29 | B | 0.17 | 3.78 | 1.78 | 3.04 | −20 |
| 30 | B | 0.17 | 3.61 | 1.79 | 3.16 | −30 |
| 31 | B | 0.18 | 3.93 | 1.78 | 3.21 | −30 |
| 32 | B | 0.17 | 3.64 | 1.82 | 3.06 | −50 |
| 33 | B | 0.17 | 3.84 | 1.77 | 3.04 | −20 |
| 34 | B | 0.18 | 3.60 | 1.83 | 3.00 | −20 |
| 35 | B | 0.20 | 3.24 | 2.05 | 3.45 | −190 |

These results clearly show that tile tone promoting agent alone does not improve the blue-black tone of the developed silver. Sodium tetrathionate has this kind of effect, but at higher concentration only.

EXAMPLE 6

Developers 36 and 37 having the composition shown in Table 11 for silver halide photographic materials were prepared.

TABLE 11

| | | Developer | |
|---|---|---|---|
| | | 36 | 37 |
| Water | g | 700 | 700 |
| $Na_2S_2O_5$ | g | 30 | 30 |
| KOH 35% (w/w) | g | 43 | 35 |
| $K_2CO_3$ | g | 41 | 41 |
| Diethanolamine | g | 6 | 6 |
| Ethyleneglycol | g | 7.5 | 7.5 |
| DTPA.5Na 40% (w/W) | g | 12.5 | 12.5 |
| Budex ™ 5103 40% sol | g | — | 5 |
| Ethanolamine | g | 10 | 10 |
| Ethylenediamine | g | — | — |
| $K_2S_4O_6$ | mg | 150 | 150 |
| $Na_2S_2O_3$ | mg | 190 | 190 |
| 5-Methylbenzotriazole | mg | 125 | 125 |
| 1-Phenyl-1-H-tetrazole-5-thiol | mg | 15 | 15 |
| 4-Hydroxymethyl-4-methyl-1-phenyl-3-pyrazolidone | g | 1.3 | 1.3 |
| Hydroquinone | g | 12 | 12 |
| Potassium bromide | g | 1.5 | 1.5 |
| Water to make | l | 1 | 1 |
| pH at 20° C. | | 10.7 | 10.7 |

Budex™5103 is the trade name of a cyclicaminomethane diphosphonic acid sold by Budenheim AG, having the following formula:

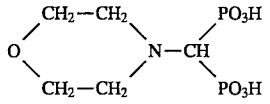

Two liters of each of the developers 36 and 37 were placed in an open evaporating dish axed left to stand at room temperature for ten days (oxidized developer). The developer compositions 34 and 35 (fresh and oxidized) were tested according the same method of example 1. The results are summarized in Table 12.

TABLE 12

| Developer | Film | D.min | D.max | Speed | Average Contrast | Image Tone |
|---|---|---|---|---|---|---|
| 36 Fresh | A | 0.18 | 3.13 | 1.91 | 3.43 | −170 |
| 36 Oxid. | A | 0.19 | 2.80 | 1.86 | 2.86 | −160 |
| 37 Fresh | A | 0.18 | 3.15 | 1.89 | 3.39 | −150 |
| 37 Oxid. | A | 0.18 | 2.95 | 1.89 | 3.15 | −180 |
| 36 Fresh | B | 0.19 | 3.39 | 1.93 | 3.25 | −170 |
| 36 Oxid. | B | 0.19 | 3.03 | 1.88 | 2.75 | −180 |
| 37 Fresh | B | 0.18 | 3.31 | 1.95 | 3.16 | −170 |
| 37 Oxid. | B | 0.19 | 3.20 | 1.92 | 3.10 | −180 |

These results show that the presence of Budex™5103 improves the resistance to air oxidaxion of the developer composition of the present invention.

We claim:

1. An alkaline black-and white x-ray film photographic developer composition having a pH of greater than 10 comprising:

(1) 2 to 100 grams per liter of at least one black-and-white developing agent, (2) 0.1 to 20 grams per liter of at least one black-and-white auxiliary developing agent, (3) 0.01 to 5 grams per liter of at least one antifoggant, (4) 1 to 60 grams per liter of at least one sequestering agent, (5) a sulfite antioxidant capable of generating 0.1 to 1.25 moles per liter of sulfite ions, (6) at least one buffering agent in a molar ratio of greater than 0.5:1 with respect to said sulfite antioxidant, (7) a tone agent, (8) a tone promoting agent, wherein said tone agent is $1\times10^{-3}$ to 2 moles per liter of a primary organic amine compound and said tone promoting agent is 0.01 to 50 mMoles per liter of a silver halide solvent.

2. The alkaline aqueous developer of claim 1, wherein said tone agent is an organic amine having the following formula:

$$R—NH_2$$

wherein R can be a substituted or unsubstituted straight or branched or cyclic aliphatic chain of from 1 to 10 carbon atoms.

3. The alkaline aqueous developer of claim 1, wherein said tone agent is used in an amount of from $1\times10^{-2}$ to 1 moles per liter of developer.

4. The alkaline aqueous developer of claim 1 wherein said tone promoting agent is selected from at least one halide salts, thiosulfates, sulfites, ammonium salts, thiourea, thiocyanates, imidazole compounds and thioether compounds.

5. The alkaline aqueous developer of claim 1, wherein said tone promoting agent is selected from at least one of sodium or potassium thiosulfates or thiocyanates.

6. The alkaline aqueous developer of claim 1 in which the black-and-white developing agent is hydroquinone, and wherein the molar ratio of said sulfite antioxidant to said hydroquinone is at least 2.5:1 and the molar ratio of said buffering agent to said sulfite antioxidant is at least 0.5:1.

7. The alkaline aqueous developer of claim 1, wherein said sequestering agent is selected from at least one of aminopolycarboxylic acids, aminopoly-phosphonic acids, cyclicaminomethane diphosphonic acids, α-hydroxycarboxylic acid compounds, dicarboxylic acid compounds, α-ketocarboxylic acid compounds, alkanolamine compounds.

8. The aqueous alkaline developer of claim 1, wherein said sequestering agent consist in a mixture of aminopolycarboxylic acids and cyclicaminomethane diphosphonic acids.

9. The alkaline aqueous developer of claim 8, wherein said cyclicaminomethane diphosphonic acids correspond to the following formula:

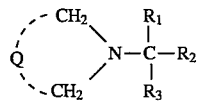

wherein $R_1$, $R_2$ and $R_3$, equal or different, each represent a hydrogen atom or a $PO_3M'M''$ group, wherein M' and M'' represent a hydrogen atom, an alkali metal or a quaternary ammonium group, and Q represents the atoms or chemical bonds necessary to complete a 3- to 6-membered ring, with the proviso that at least two of $R_1$, $R_2$ and $R_3$ substituents represent a $PO_3M'M''$ group.

10. The alkaline aqueous developer of claim 8, wherein said cyclicaminomethanediphosphonic acid corresponds to the formula:

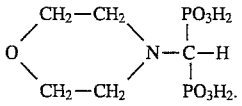

11. The alkaline aqueous developer of claim 8, wherein said mixture of sequestering agents is used in a total amount of from 1 to about 60 grams per liter of said developer.

12. The alkaline aqueous developer of claim 1, wherein said aqueous developer comprises an auxiliary tone modifying agent.

13. The alkaline aqueous developer of claim 12, wherein said auxiliary tone modifying agent is an alkali metal or ammonium salt of a polythionic acid.

14. The alkaline aqueous developer of claim 12, wherein said auxiliary tone modifying agent is an alkali metal or ammonium salt of tetrathionic acid.

15. The alkaline aqueous developer of claim 12, wherein said auxiliary tone modifying agent is used in an amount of from 0 to 0.4 grams per liter of developer.

16. The alkaline aqueous developer of claim 1, wherein said black-and-white developing agent is present in the developer in an amount of from 6 to 50 grams per liter and said auxiliary developing agent is present in an amount of from 0.5 to 5 grams per liter.

17. The alkaline aqueous developer of claim 1, wherein said antifoggant comprises a combination of a benzimidazole-type, benzotriazole-type, tetrazole-type, indazole-type, thiazole-type antifoggant, and a mercaptotetrazole-type antifoggant.

18. The alkaline aqueous developer of claim 1, wherein said antifoggant comprises a combination of 5-methylbenzotriazole and 1-phenyl-1-H-tetrazole-5-thiol.

19. The alkaline aqueous developer of claim 17, wherein said antifoggant combination is added in an amount of from about 0.02 to 3 grams per liter of the ready-to-use developer composition.

20. The alkaline black-and white photographic developer of claim 1 wherein said developer contains an exposed x-ray film.

21. An alkaline black-and white x-ray film photographic developer composition having a pH of greater than 10 consisting essentially of:

(1) 2 to 100 grams per liter of at least one black-and-white developing agent, (2) 0.1 to 20 grams per liter of at least one black-and-white auxiliary developing agent, (3) 0.01 to 5 grams per liter of at least one antifoggant, (4) 1 to 60 grams per liter of at least one sequestering agent, (5) a sulfite antioxidant capable of generating 0.1 to 1.25 moles per liter of sulfite ions, (6) at least one buffering agent in a molar ratio of greater than 0.5:1 with respect to said sulfite antioxidant, (7) a tone agent, (8) a tone promoting agent, wherein said tone agent is $1\times10^{-3}$ to 2 moles per liter of a primary organic amine compound and said tone promoting agent is 0.01 to 50 mMoles per liter of a silver halide solvent.

* * * * *

UNITED STATES PATENT AND TRADEMARK OFFICE

CERTIFICATE OF CORRECTION

PATENT NO.: 5,478,706

DATED: Dec. 26, 1995

INVENTOR(S): Carlo Marchesano, Flippo Faranda and Franco Buriano

It is certified that error appears in the above-identified patent and that said Letters Patent is hereby corrected as shown below:

Column 3, lines 22-23, delete "2-methyl1-cy-clopentylamine," and insert –2-methyl-1-cyclopentylamine,–.

Column 5, lines 21-22, delete "a-hydroxycar-boxylic" and insert –α-hydroxy-carboxylic–.

Column 5, lines 23-24, delete "a-keto-carboxylic" and insert –α-ketocarboxylic–.

Column 15, line 39, delete "axed" and insert –and–.

Col. 16, lines 28-29, delete "thio-cyanates," and insert —thiocyanates,—.

Signed and Sealed this

Twenty-third Day of April, 1996

Bruce Lehman

*Attest:*

BRUCE LEHMAN

*Attesting Officer*

*Commissioner of Patents and Trademarks*